US008978384B2

(12) United States Patent
Bailey et al.

(10) Patent No.: US 8,978,384 B2
(45) Date of Patent: Mar. 17, 2015

(54) SWIRLER ASSEMBLY WITH COMPRESSOR DISCHARGE INJECTION TO VANE SURFACE

(75) Inventors: Donald Mark Bailey, Greenville, SC (US); Abdul Rafey Khan, Greenville, SC (US); Mohan Krishna Bobba, Greenville, SC (US)

(73) Assignee: General Electric Company, Schenectady, NY (US)

( * ) Notice: Subject to any disclaimer, the term of this patent is extended or adjusted under 35 U.S.C. 154(b) by 660 days.

(21) Appl. No.: 13/303,888

(22) Filed: Nov. 23, 2011

(65) Prior Publication Data

US 2013/0125553 A1 May 23, 2013

(51) Int. Cl.

| | |
|---|---|
| ***F02C 1/00*** | (2006.01) |
| ***F02G 3/00*** | (2006.01) |
| ***F23R 3/14*** | (2006.01) |
| ***F23R 3/28*** | (2006.01) |

(52) U.S. Cl.

CPC . *F23R 3/14* (2013.01); *F23R 3/283* (2013.01); *F23R 3/286* (2013.01)

USPC ..... 60/748; 60/737; 60/740; 60/746; 60/747

(58) Field of Classification Search

USPC ..... 60/748, 737, 746, 747, 740, 742; 239/399, 403, 405

See application file for complete search history.

(56) References Cited

U.S. PATENT DOCUMENTS

| | | | | |
|---|---|---|---|---|
| 4,029,465 | A | 6/1977 | LaHaye et al. | |
| 4,144,020 | A | 3/1979 | LaHaye et al. | |
| 4,201,047 | A | 5/1980 | Warren et al. | |
| 4,313,721 | A | 2/1982 | Henriques | |
| 6,079,199 | A | 6/2000 | McCaldon et al. | |
| 6,155,056 | A | 12/2000 | Sampath et al. | |
| 6,389,815 | B1 | 5/2002 | Hura et al. | |
| 6,438,961 | B2 * | 8/2002 | Tuthill et al. | 60/776 |
| 6,536,201 | B2 | 3/2003 | Stuttaford et al. | |
| 6,655,145 | B2 * | 12/2003 | Boardman | 60/737 |
| 6,662,565 | B2 | 12/2003 | Brundish et al. | |
| 6,675,581 | B1 * | 1/2004 | Stuttaford et al. | 60/737 |
| 6,711,900 | B1 | 3/2004 | Patel et al. | |
| 6,871,488 | B2 | 3/2005 | Oskooei et al. | |
| 6,880,341 | B2 | 4/2005 | Parkman et al. | |
| 6,886,342 | B2 | 5/2005 | Alkabie | |
| 7,007,477 | B2 | 3/2006 | Widener | |
| 7,024,863 | B2 | 4/2006 | Morenko | |
| 7,062,919 | B2 | 6/2006 | Alkabie | |
| 7,165,405 | B2 * | 1/2007 | Stuttaford et al. | 60/737 |
| 7,171,813 | B2 * | 2/2007 | Tanaka et al. | 60/737 |
| 7,234,304 | B2 | 6/2007 | Alkabie | |
| 7,412,833 | B2 | 8/2008 | Widener | |

(Continued)

FOREIGN PATENT DOCUMENTS

| | | | |
|---|---|---|---|
| EP | 1186832 | A2 | 3/2002 |
| EP | 1084371 | B1 | 9/2003 |

(Continued)

*Primary Examiner* — William H Rodriguez
(74) *Attorney, Agent, or Firm* — Nixon & Vanderhye P.C.

(57) ABSTRACT

A swirler assembly in a gas turbine combustor includes a hub, a shroud, and a plurality of vanes connected between the hub and the shroud. The vanes include a high pressure side on which air and fuel impinge the vanes and a low pressure side. An air circuit is provided in each of the plurality of vanes receiving discharge air from a compressor. Each of the air circuits includes an air entry passage into the vanes and an air exit passage on the low pressure side of the vanes.

19 Claims, 3 Drawing Sheets

(56) References Cited

U.S. PATENT DOCUMENTS

| | | | | |
|---|---|---|---|---|
| 7,441,409 | B2 | 10/2008 | Patel et al. | |
| 7,490,471 | B2 * | 2/2009 | Lynch et al. | 60/748 |
| 7,533,534 | B2 | 5/2009 | Alkabie | |
| 7,546,735 | B2 | 6/2009 | Widener | |
| 7,631,503 | B2 | 12/2009 | Stastny et al. | |
| 7,669,421 | B2 * | 3/2010 | Saitoh et al. | 60/748 |
| 7,861,528 | B2 | 1/2011 | Myers et al. | |
| 7,908,864 | B2 * | 3/2011 | Haynes et al. | 60/748 |
| 8,024,932 | B1 * | 9/2011 | Stewart | 60/748 |
| 8,065,880 | B2 * | 11/2011 | Ishizaka et al. | 60/737 |
| 8,104,286 | B2 * | 1/2012 | Zuo et al. | 60/748 |
| 8,365,535 | B2 * | 2/2013 | Widener et al. | 60/742 |
| 8,393,157 | B2 * | 3/2013 | Dinu | 60/748 |
| 8,528,839 | B2 * | 9/2013 | Bailey et al. | 239/405 |
| 8,661,779 | B2 * | 3/2014 | Laster et al. | 60/39.463 |
| 8,820,047 | B2 * | 9/2014 | Saito et al. | 60/39.55 |
| 2002/0069644 | A1 | 6/2002 | Stuttaford et al. | |
| 2004/0112061 | A1 | 6/2004 | Oskooei et al. | |
| 2004/0112062 | A1 | 6/2004 | Alkabie | |
| 2004/0118121 | A1 | 6/2004 | Parkman et al. | |
| 2004/0159106 | A1 | 8/2004 | Patel et al. | |
| 2005/0016182 | A1 | 1/2005 | Morenko | |
| 2005/0144956 | A1 | 7/2005 | Alkabie | |
| 2005/0268614 | A1 | 12/2005 | Widener | |
| 2006/0010878 | A1 | 1/2006 | Widener | |
| 2006/0080966 | A1 | 4/2006 | Widener | |
| 2006/0191268 | A1 * | 8/2006 | Widener et al. | 60/772 |
| 2007/0095067 | A1 | 5/2007 | Alkabie | |
| 2007/0227119 | A1 | 10/2007 | Alkabie | |
| 2007/0234726 | A1 | 10/2007 | Patel et al. | |
| 2008/0060360 | A1 | 3/2008 | Stastny et al. | |
| 2008/0148738 | A1 | 6/2008 | Rudrapatna et al. | |
| 2008/0289341 | A1 * | 11/2008 | Ishizaka et al. | 60/748 |
| 2009/0050710 | A1 | 2/2009 | Myers et al. | |
| 2009/0293482 | A1 | 12/2009 | Davis, Jr. et al. | |
| 2010/0263381 | A1 * | 10/2010 | Ishizaka et al. | 60/737 |
| 2010/0293954 | A1 | 11/2010 | Widener | |
| 2013/0283805 | A1 * | 10/2013 | Zuo | 60/748 |
| 2014/0238025 | A1 * | 8/2014 | Uhm et al. | 60/737 |

FOREIGN PATENT DOCUMENTS

| | | | |
|---|---|---|---|
| EP | 1084372 | B1 | 7/2004 |
| EP | 1696178 | A2 | 8/2006 |
| EP | 1350018 | B1 | 10/2006 |
| EP | 1585921 | B1 | 1/2007 |
| EP | 1199522 | B1 | 5/2009 |
| EP | 1676079 | B1 | 4/2010 |
| EP | 1604149 | B1 | 1/2011 |
| WO | WO 99/63274 | A1 | 12/1999 |
| WO | WO 99/63275 | A1 | 12/1999 |
| WO | WO 02/48527 | A1 | 6/2002 |
| WO | WO 2004/038181 | A1 | 5/2004 |
| WO | WO 2004/055434 | A1 | 7/2004 |
| WO | WO 2004/055438 | A1 | 7/2004 |
| WO | WO 2004/055439 | A1 | 7/2004 |
| WO | WO 2004/070275 | A1 | 8/2004 |

* cited by examiner

SWIRLER ASSEMBLY WITH COMPRESSOR DISCHARGE INJECTION TO VANE SURFACE

BACKGROUND OF THE INVENTION

The invention relates to gas turbines and, more particularly, to a swirler assembly in a gas turbine combustor including an air circuit in the swirler vanes that directs compressor discharge air to a low pressure side of the swirler vanes.

In a gas turbine combustor, compressed air from the compressor and fuel are mixed upstream of a combustion zone. A swirler assembly includes circumferentially spaced apart vanes for swirling and mixing the compressed air flow and the fuel passing therethrough.

The swirler assemblies, also described as swozzle assemblies, may have flame holding margins limited by flow deficits on a suction side of the vane turning region. This reduced flame holding margin and locally enriched air/fuel regions reduce the performance of the combustor.

BRIEF DESCRIPTION OF THE INVENTION

In an exemplary embodiment, a swirler assembly in a gas turbine combustor includes a hub, a shroud, and a plurality of vanes connected between the hub and the shroud. The vanes include a high pressure side on which air and fuel impinge the vanes and a low pressure side. An air circuit is provided in each of the plurality of vanes receiving discharge air from a compressor. Each of the air circuits includes an air entry passage into the vanes and an air exit passage on the low pressure side of the vanes.

In another exemplary embodiment, a gas turbine includes a compressor that progressively compresses a working fluid such as air, a combustor injecting fuel into the compressed air and igniting the air and fuel to produce combustion gases, and a turbine using the combustion gases to produce work. The combustor includes a swirler assembly that imparts swirl to the air and the fuel. The swirler assembly comprises a hub, a shroud, a plurality of vanes connected between the hub and the shroud, and an air circuit in each of the plurality of vanes. The air and fuel impinge the vanes on a high pressure side. The air circuit in each of the plurality of vanes receives discharge air from the compressor, where each of the air circuits includes an air entry passage into the vanes and an air exit passage on the low pressure side of the vanes.

In yet another exemplary embodiment, a method of mixing fuel and air in a swirler assembly includes the steps of providing an air circuit in each of the plurality of vanes, each of the air circuits including an air entry passage into the vanes and an air exit passage on the low pressure side of the vanes; and directing airflow from a compressor to the air entry passage into the vanes and through the air exit passage on the low pressure side of the vanes.

DETAILED DESCRIPTION OF THE INVENTION

Figure 1:
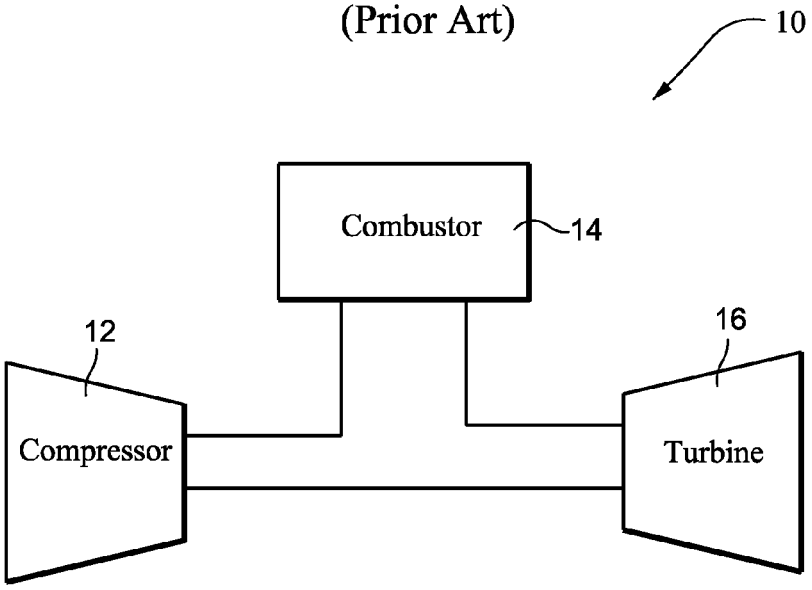
Fig. 1 (Prior Art)
FIG. 1 is a simplified schematic of a gas turbine.

FIG. 1 illustrates a typical gas turbine 10. As shown, the gas turbine 10 generally includes a compressor at the front, one or more combustors 14 around the middle, and a turbine 16 at the rear. The compressor 12 and the turbine 16 typically share a common rotor. The compressor 12 progressively compresses a working fluid, such as air, and discharges the compressed working fluid to the combustors 14. The combustors 14 inject fuel into the flow of compressed working fluid and ignite the mixture to produce combustion gases having a high temperature, pressure and velocity. The combustion gases exit the combustors 14 and flow to the turbine 16 where they expand to produce work.

A casing surrounds each combustor 14 to contain the compressed working fluid from the compressor 12. Nozzles are arranged in an end cover, for example, with outer nozzles radially arranged around a center nozzle. The compressed working fluid from the compressor 12 flows between the casing and a liner to the outer and center nozzles, which mix fuel with the compressed working fluid, and the mixture flows from the outer and center nozzles into upstream and downstream chambers where combustion occurs.

Figure 2:
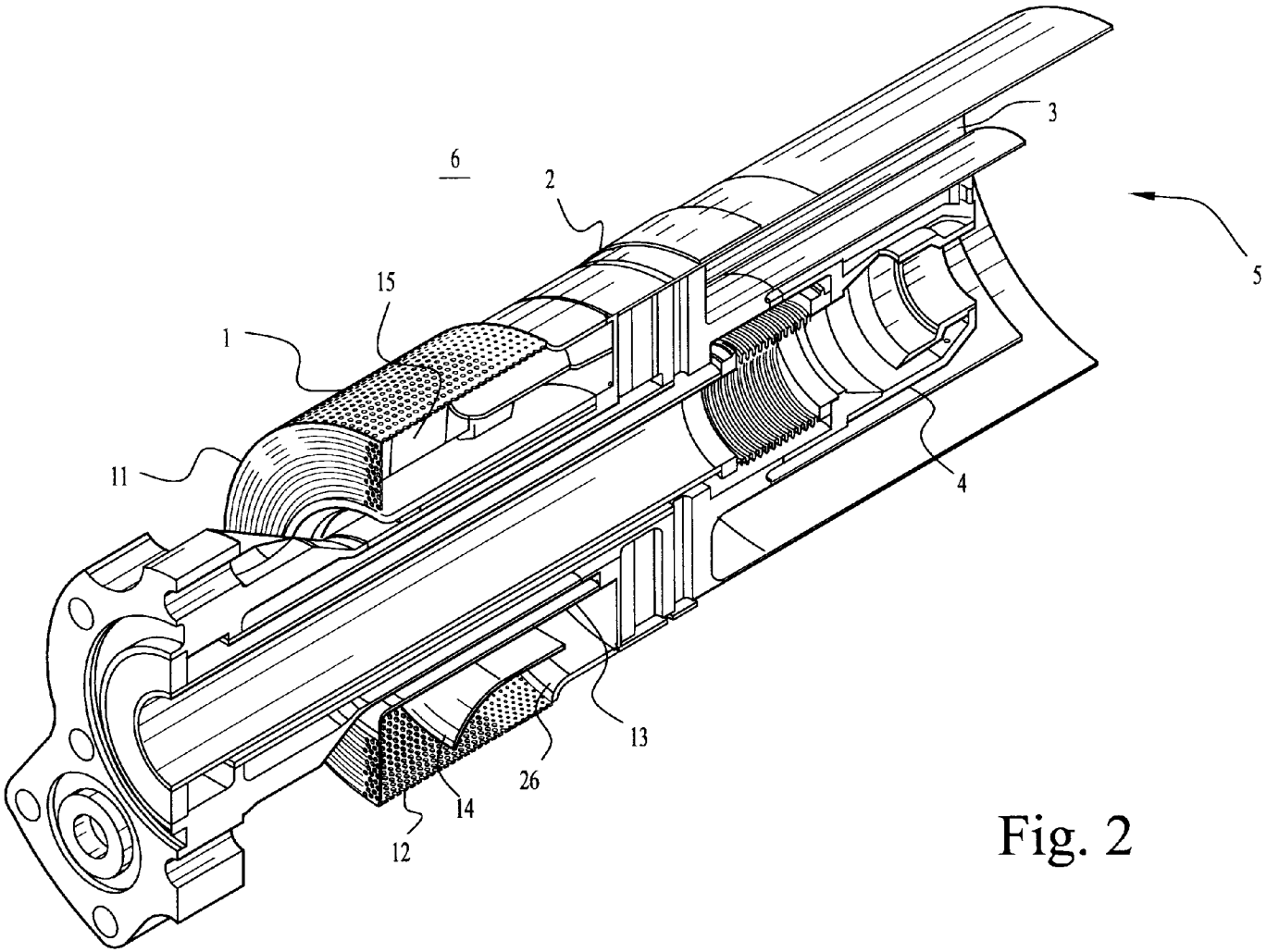
FIG. 2 is a cross-section through a fuel nozzle in a gas turbine.

FIG. 2 is a cross-section through a fuel nozzle in a gas turbine. The nozzle assembly is divided into four regions by function including an inlet flow conditioner 1, an air swirler assembly (referred to as a swozzle assembly) 2, an annular fuel air mixing passage 3, and a central diffusion flame fuel nozzle assembly 4.

Air enters the burner from a high pressure plenum 6, which surrounds the entire assembly except the discharge end, which enters the combustor reaction zone 5. Most of the air for combustion enters the premixer via the inlet flow conditioner (IFC) 1. The IFC includes an annular flow passage 15 that is bounded by a solid cylindrical inner wall 13 at the inside diameter, a perforated cylindrical outer wall 12 at the outside diameter, and a perforated end cap 11 at the upstream end. In the center of the flow passage 15 is one or more annular turning vanes 14. Premixer air enters the IFC 1 via the perforations in the end cap and cylindrical outer wall.

The perforated walls 11, 12 perform the function of backpressuring the system and evenly distributing the flow circumferentially around the IFC annulus 15, whereas the turning vane(s) 14, work in conjunction with the perforated walls to produce proper radial distribution of incoming air in the IFC annulus 15.

To eliminate low velocity regions near the shroud wall 202 at the inlet to the swozzle 2, a bell-mouth shaped transition 26 may be used between the IFC and the swozzle.

After combustion air exits the IFC 1, it enters the swozzle assembly 2. The swozzle assembly includes a hub 201 and a shroud 202 connected by a series of air foil shaped turning vanes 23, which impart swirl to the combustion air passing through the premixer (see FIGS. 3 and 4). After exiting the annular passage 3, the fuel/air mixture enters the combustor reaction zone 5 where combustion takes place.

Figure 3:
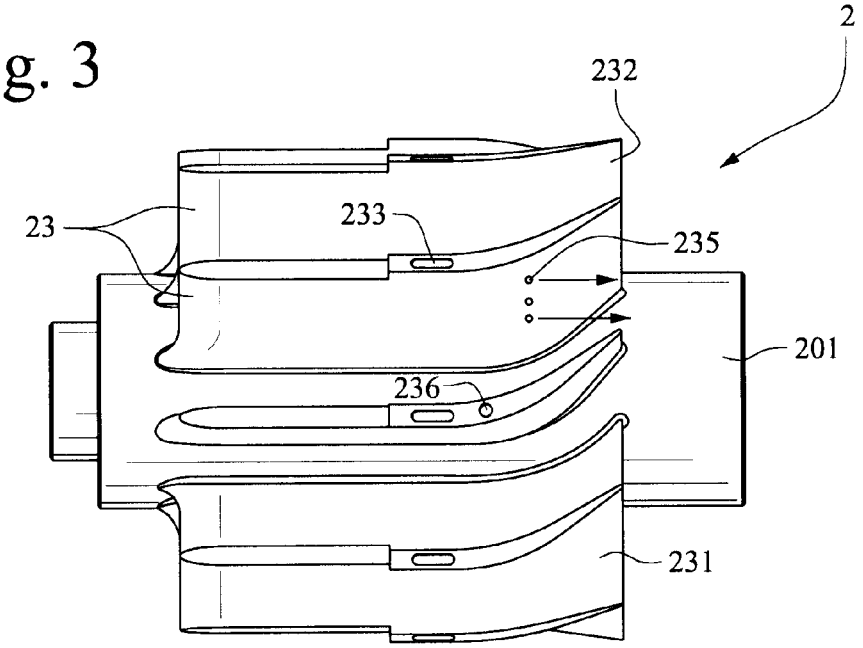
FIG. 3 shows a swirler assembly with the shroud removed.
Figure 4:
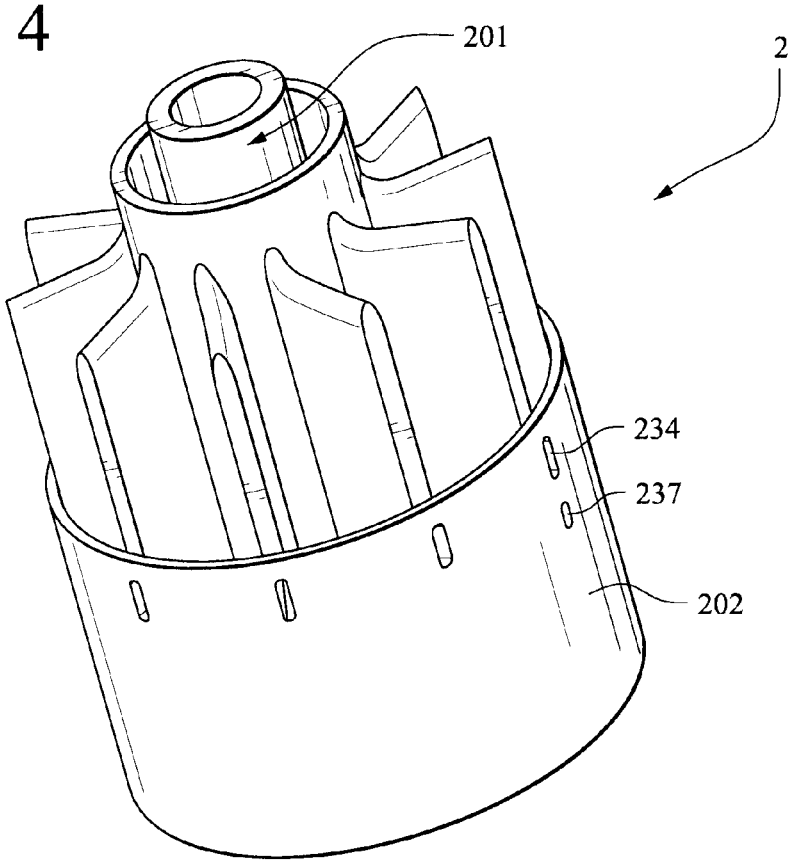
FIG. 4 is a perspective view of the swirler assembly.

FIGS. 3 and 4 show the swirler assembly 2 according to preferred embodiments. As shown, the swirler assembly 2 includes the hub 201, the shroud 202, and a plurality of vanes 23 connected between the hub and the shroud. The side 231 of the vanes 23 on which air and fuel impinge the vanes is a high pressure side. The opposite side 232 is a low pressure side.

In some existing swirler assembly designs, the vanes 23 include a cap feed channel 233 and a corresponding opening 234 in the shroud 202. Compressor discharge air is fed to the cap feed channel 233 through the vane 23 and hub 201 of the swirler assembly then out through the nozzle tip to provide for nozzle tip cooling.

An air circuit is provided in each of the plurality of vanes 23. The air circuit receives discharge air from the compressor. Each of the air circuits includes an air entry passage into the vanes and an air exit passage on the low pressure side of the vanes. In one embodiment, the air entry passage of the air circuit is defined by the cap feed 233. The exit passage comprises holes 235 in the low pressure side 232 of the vane that extend into the cap feed 233. In this embodiment, a portion of the compressor discharge air in the cap feed 233 is diverted through the exit passage 235 to the low pressure side of the vanes 23.

In an alternative embodiment, a dedicated passage 236 through the vane 23 is provided for the air circuit, which passage 236 is separate from the cap feed passage 233. In this embodiment, the air exit passage includes the holes 235 on the low pressure side of the vanes 23. The holes 235 in this embodiment extend into the dedicated passage 236 through which compressor discharge air is directed. In this embodiment, a corresponding hole 237 is provided in the shroud 202.

Preferably, the compressor discharge air is received directly from the compressor. Swirler vane low pressure injection air can be provided from either the compressor discharge or from an alternate pressure feed source. The compressor discharge feed can be taken at any point along the compressor discharge path up to the annular section feeding the combustor head end. Compressor discharge air taken directly from the exit of the compressor will be at a higher pressure (as compared to the combustor head end pressure) which may benefit swirler vane low pressure injection by creating a greater pressure differential on the suction flow deficit region of the vane. An alternate pressure feed may also be utilized to further enhance the flow/pressure differential on the vane suction side injection.

The swirler assembly 2 enables higher pressure clean compressor discharge air to be injected along either the pressure or suction side of the swozzle vane to improve fuel mixing locally. Injecting compressor discharge air along the vane edge can add needed air to low flow regions of the swozzle vane thus increasing flame holding margin, improving fuel mixing, and improving operability and flame stability by reducing local rich fuel pockets. Injection air can be supplied from the compressor discharge either adjacent the compressor exit (highest pressure available) or along the compressor feed circuit up to the annular feed leading to the combustor head end (lowest pressure differential). An alternate air pressure feed could also be utilized from an auxiliary compressor at a further elevated pressure and/or lower temperature. The air injection can occur on the vane suction side and/or vane pressure side and include an upstream air curtain to shroud the vane surface with higher pressure and/or lower temperature air to further facilitate fuel mixing and pressure deficit elimination.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A swirler assembly in a gas turbine combustor, the swirler assembly comprising:

a hub;

a shroud;

a plurality of vanes connected between the hub and the shroud, the vanes including a high pressure side on which air and fuel impinge the vanes and a low pressure side; and an air circuit in each of the plurality of vanes receiving discharge air from a compressor, each of the air circuits including an air entry passage into the vanes and an air exit passage on the low pressure side of the vanes.

2. A swirler assembly according to claim 1, wherein the air entry passage comprises a cap feed passage that directs the compressor discharge air into the hub toward a nozzle tip, and wherein a portion of the compressor discharge air is diverted through the exit passage to the low pressure side of the vanes.

3. A swirler assembly according to claim 2, further comprising a cap feed opening in the shroud.

4. A swirler assembly according to claim 1, further comprising a cap feed passage that directs the compressor discharge air into the hub toward a nozzle tip, wherein the air entry passage is separate from the cap feed passage.

5. A swirler assembly according to claim 1, wherein the air exit passage comprises a plurality of holes through the low pressure side of the vanes.

6. A swirler assembly according to claim 1, wherein the air entry passage receives the air directly from the compressor.

7. A swirler assembly according to claim 1, wherein the air entry passage is accessed via an opening in a side of the vane.

8. A gas turbine comprising:

a compressor that progressively compresses a working fluid, the working fluid comprising air;

a combustor injecting fuel into the compressed air and igniting the air and fuel to produce combustion gases; and a turbine using the combustion gases to produce work, wherein the combustor includes a swirler assembly that imparts swirl to the air and the fuel, the swirler assembly including a hub, a shroud, a plurality of vanes connected between the hub and the shroud, and an air circuit in each of the plurality of vanes, the vanes including a high pressure side on which the working fluid air and fuel impinge the vanes and a low pressure side, the air circuit in each of the plurality of vanes receiving discharge air from the compressor, wherein each of the air circuits includes an air entry passage into the vanes and an air exit passage on the low pressure side of the vanes.

9. A gas turbine according to claim 8, wherein the air entry passage comprises a cap feed passage that directs the compressor discharge air into the hub toward a nozzle tip, and wherein a portion of the compressor discharge air is diverted through the exit passage to the low pressure side of the vanes.

10. A gas turbine according to claim 9, further comprising a cap feed opening in the shroud.

11. A gas turbine according to claim 8, further comprising a cap feed passage that directs the compressor discharge air into the hub toward a nozzle tip, wherein the air entry passage is separate from the cap feed passage.

12. A gas turbine according to claim 8, wherein the air exit passage comprises a plurality of holes through the low pressure side of the vanes.

13. A gas turbine according to claim 8, wherein the air entry passage receives the air directly from the compressor.

14. A gas turbine according to claim 8, wherein the air entry passage is accessed via an opening in a side of the vane.

15. A method of mixing fuel and air in a swirler assembly, the swirler assembly including a hub, a shroud, and a plurality of vanes connected between the hub and the shroud, the vanes including a high pressure side on which air and fuel impinge the vanes and a low pressure side, the method comprising:

providing an air circuit in each of the plurality of vanes, each of the air circuits including an air entry passage into the vanes and an air exit passage on the low pressure side of the vanes; and directing airflow from a compressor to the air entry passage into the vanes and through the air exit passage on the low pressure side of the vanes.

16. A method according to claim 15, wherein the air entry passage comprises a cap feed passage that directs the compressor discharge air into the hub toward a nozzle tip, and wherein the directing step is practiced by diverting a portion of the compressor discharge air through the exit passage to the low pressure side of the vanes.

17. A method according to claim 15, wherein the providing step is practiced by providing the air exit passage with a plurality of holes through the low pressure side of the vanes.

18. A method according to claim 15, wherein directing step is practiced by directing the airflow to the air entry passage directly from the compressor.

19. A method according to claim 15, wherein the providing step is practiced providing an opening in a side of the vane.

* * * * *